US005605524A

United States Patent [19]

Husted

[11] Patent Number: 5,605,524

[45] Date of Patent: Feb. 25, 1997

[54] EXERCISE DEVICE

[76] Inventor: Royce H. Husted, R.R. 4, Box 550, Forest, Va. 24551

[21] Appl. No.: 394,505

[22] Filed: Feb. 27, 1995

Related U.S. Application Data

[63] Continuation-in-part of Ser. No. 260,877, Jun. 16, 1994, abandoned.

[51] Int. Cl.[6] ..... A63B 21/008

[52] U.S. Cl. ..... 482/112; 482/137; 482/142

[58] Field of Search ..... 482/111, 112, 482/129, 130, 137, 138, 142

[56] References Cited

U.S. PATENT DOCUMENTS

| | | | |
|---|---|---|---|
| 3,756,595 | 9/1973 | Hague | 482/112 |
| 4,275,882 | 6/1981 | Grosser et al. | 482/112 |
| 4,643,420 | 2/1987 | Riley et al. | 482/130 |
| 4,711,448 | 12/1987 | Minkow et al. | 482/137 |
| 4,880,227 | 11/1989 | Sowell | 482/112 |
| 5,078,391 | 1/1992 | Moore, Sr. | 482/62 |

FOREIGN PATENT DOCUMENTS

| | | | |
|---|---|---|---|
| 0135346 | 3/1985 | European Pat. Off. | 482/112 |

*Primary Examiner*—Lynne A. Reichard
*Attorney, Agent, or Firm*—Nicholas A. Camasto

[57] ABSTRACT

A triangular articulated lever system is supported on a vertical support tube. The system includes a pair of swing arms that are pivotally mounted on the support tube for supporting a lifting bar. A threaded extension of a gas cylinder spring arm is coupled to an articulated mount at an apex of the triangular lever system formed by the swing arms and the spring arm. The cylinder is coupled by a clevis arrangement to a lead screw for changing the configuration of the articulated triangular lever system and adjusting the load at the lifting bar. A bench is positioned beneath the lifting bar and is pivotally mounted to a base for rotation out from underneath the lifting bar for non bench exercises. The lifting bar is mounted for limited universal movement at the end of the swing arms and is rotatable about its longitudinal axis. The preferred embodiment has a cylindrical serpentine shaped tube configuration.

25 Claims, 11 Drawing Sheets

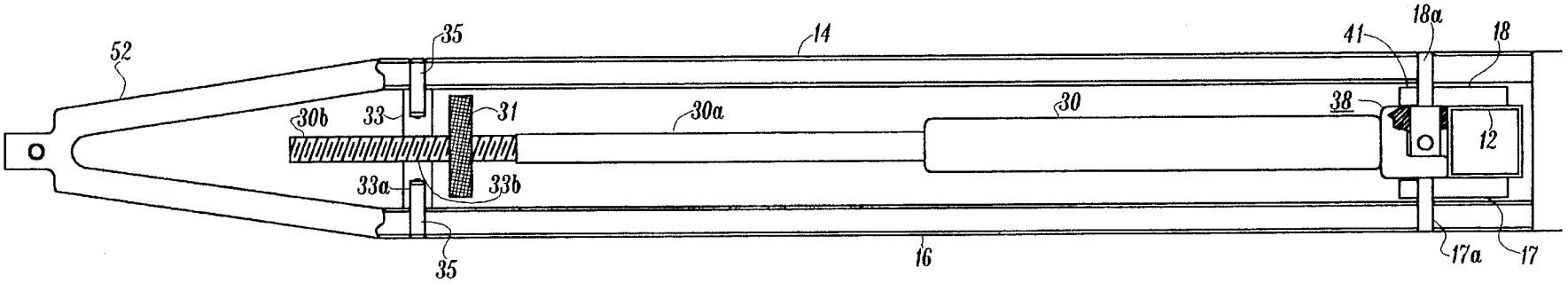
FIG. 3
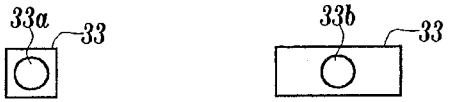
FIG. 4A
FIG. 4B

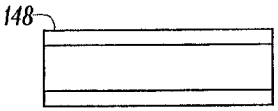
FIG. 17A
FIG. 17B
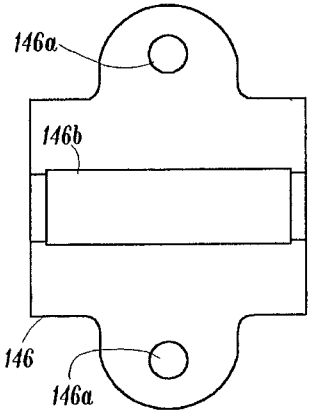
FIG. 16B
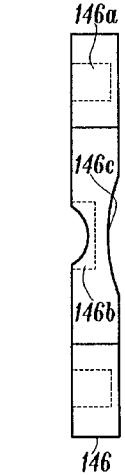
FIG. 16A
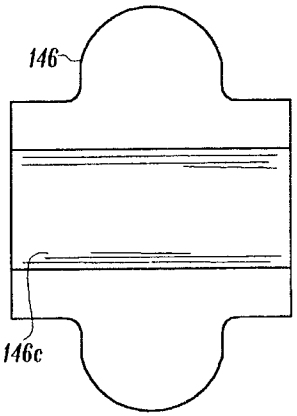
FIG. 16C
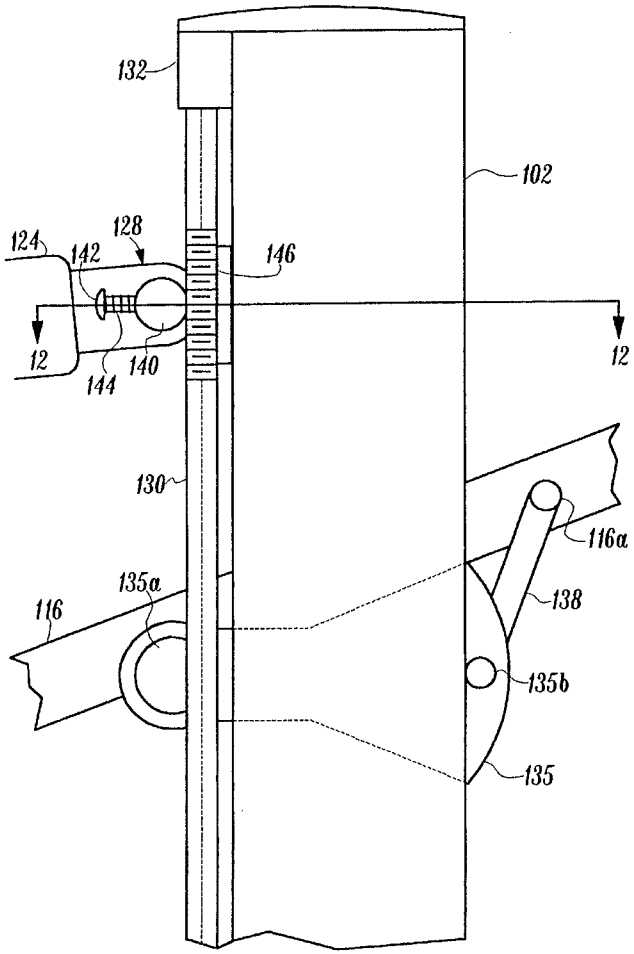
FIG. 11

EXERCISE DEVICE

CROSS REFERENCE TO RELATED APPLICATION

This application is a continuation in part of Ser. No. 08/260,877, filed Jun. 16, 1994 now abandoned.

BACKGROUND OF THE INVENTION AND PRIOR ART

This invention relates generally to exercise equipment and particularly to an exercise device that not only simulates free weights, but surpasses free weights in providing non deleterious loads for exercising the various muscle groups. Physical fitness is a goal that is pursued by a large number of people who regularly perform some type of exercise, whether in a home environment or in a special exercise facility, such as a health club or fitness center. The exercise facility generally includes a variety of exercise machines and equipment, ranging from very simple to very elaborate. The stack weight type of exercise equipment is generally considered to be superior to devices that rely upon springs, rubber bands, or velocity loading to provide a load against which the muscles of the person doing the exercising must work. This is because spring loading mechanisms characteristically vary in force or load delivery and are not really comparable to the loads provided by a free weight workout. Velocity type devices are even worse since their load delivery is a function of speed of movement.

Health clubs and fitness centers generally employ elaborate stack weight exercise machines, which have stacks of weights that are lifted by one or more cables. The weights are usually captive, that is, confined to movement in a track or path. Such machines force the user to adapt to the machine since the lifting bar has a generally fixed position. The same holds true for the other user operated devices on the exercise machine. Consequently, the user often finds himself severely restricted in the range of movements of his muscles when using the lifting (or pull down) bar on such machines. These restrictions on muscle movement impose unnatural and potentially harmful stresses and strains on the joints, muscles and tendons of the user. Problems of the above type are compounded in exercise machines that are designed for home use. Further, in a home environment, the weight and bulk of free weights and stack weights, coupled with the inherent dangers associated therewith to person and property, strongly militate against their use. Consequently, most home exercise devices and equipment rely upon springs, heavy duty rubber bands and velocity loading devices for developing the necessary forces to enable the user to experience a beneficial workout.

Adjustments in the load force provided by the mechanisms are generally inconvenient to make and often there is very little accuracy in determining the load change associated with the adjustment. Yet this is not the major drawback of such machines. By far the biggest failing of home type exercise machines is the nonuniform loads exhibited by the machines (and imposed upon the muscles of the user) during the exercise stroke or cycle. The resistance loading of rubber bands or straps and springs is inherently nonlinear and increases with the degree of stretching experienced. Consequently, the load resistance is much higher at the fully stretched position than it is when the device is close to the relaxed position. Similarly, velocity type load devices offer very high resistance to rapid movements and practically no resistance to slow movements. This, incidentally, is also the problem with devices using friction and hydraulics, in which the resistance developed is a function of speed of movement or the amount of force applied.

While certain prior art devices superficially appear to operate in a manner similar to the present invention, they are, in fact, significantly different. The invention, as will be seen, employs an articulated triangular lever arm system having a spring means with a free length as one arm thereof, with adjustments in loading being made by adjusting the lengths of any combination of two arms of the articulated triangular lever arm system.

A prior art published patent application to Horng EP 0135346 includes a damper (a hydraulic cylinder) that provides resistance to movement. The damper is not a spring, has no free length and affords a resistance that is a function of the applied force. The device includes a variable orifice arrangement for the hydraulic cylinder for adjusting the resistance offered. The Sowell U.S. Pat. No. 4,880,227 similarly discloses a hydraulic cylinder (dashpot) as the load imparting device. While a triangular lever arm system is shown, the hydraulic cylinder has no free length and merely adjusts its static position as required by any change in the other arms of the system.

The above patents are representative of the state of the art. Neither simulates the free weight loading achieved by the present invention.

It is well known that to maximize muscle development and exercise, the load experienced by the muscle should, optimally, be constant. Measured against this criterion of constant loading, even free weights and professional stack weight lifting equipment fail and can be shown to be quite erratic in muscle loading. This is due to the large inertia of the weights. The results of bench pressing with free weights, for example, clearly shows that the loading varies from practically zero at the top of the stroke to a severe overload at the bottom of the stroke due to the inertia of the weights. Large variations in loading not only result in a much lower average workout for the muscles, but can be very injurious to the muscle structure.

The exercise device of the present invention solves the problems inherent in all such devices. Further, the inventive system surpasses the exercise effect of free weights while avoiding the inconvenience and danger of free weights. Also, with the invention, the user is not confined to movements imposed by conventional exercise machines even though it includes an attached lifting bar. This is due to a novel coupling arrangement that permits universal movement of the lifting bar with respect to the lifting mechanism and a provision for rotation of the bar around its axis. The exercise device of the invention also enables a simple conversion from lifting exercises to pull down exercises without requiring the disassembling of any components of the machine. The inventive device is used with a novel aesthetically pleasing tubular frame for strength and simplicity. A pivotable bench is also included for conveniently converting from bench to non bench type exercises.

OBJECTS OF THE INVENTION

A principal object of the invention is to provide a novel exercise method and device.

Another object of the invention is to provide an exercise device that provides substantially constant loading.

A further object of the invention is to provide an improved exercise device.

A still further object of the invention is to provide an improved exercise method and device that overcomes deficiencies of prior art free weight exercise systems.

Yet another object is to provide a novel structural arrangement for use with the exercise device of the invention.

BRIEF DESCRIPTION OF THE DRAWING

These and other objects and advantages of the invention will be apparent upon reading the following description in conjunction with the drawings wherein like reference characters denote like elements, and in which:

FIG. 3 is a partial top view of the swing arms and loading mechanism of the invention;

FIG. 4A is a view of the articulated member taken along the lines 4—4 of FIG. 3;

FIG. 4B is an end view of the articulated member of FIG. 4;

FIG. 11 is an enlarged view of a portion of the swing arm and the cylinder locking mechanism;

FIGS. 16A–16C are various views of the locking adjustment molded slidable back plate;

FIGS. 17A and 17B are views of the steel insert for the molded slidable back plate;

DESCRIPTION OF THE PREFERRED EMBODIMENT

Figure 1:
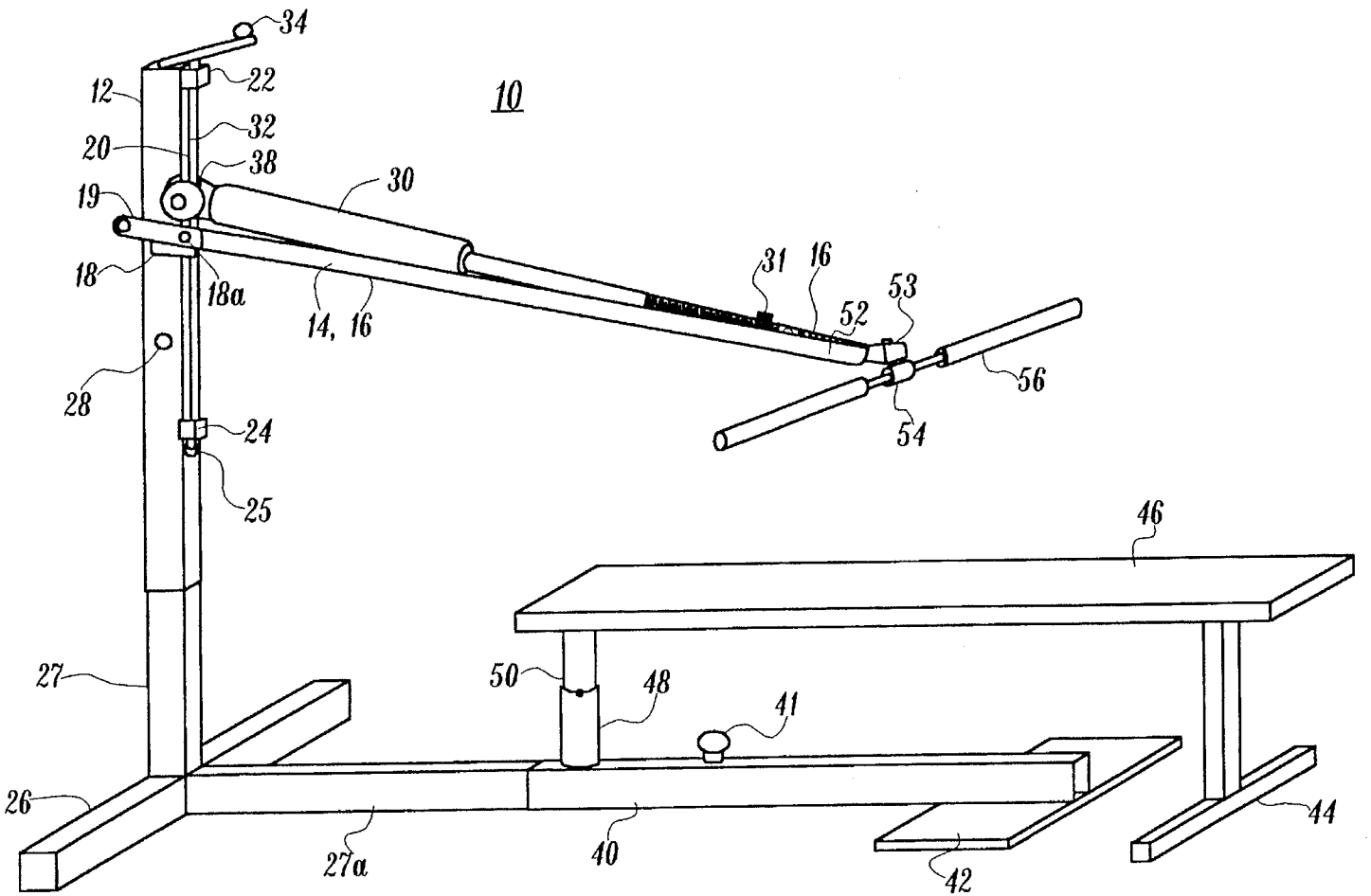
FIG. 1 is a perspective view of an exercise bench incorporating the exercise device of the invention.
Figure 7:
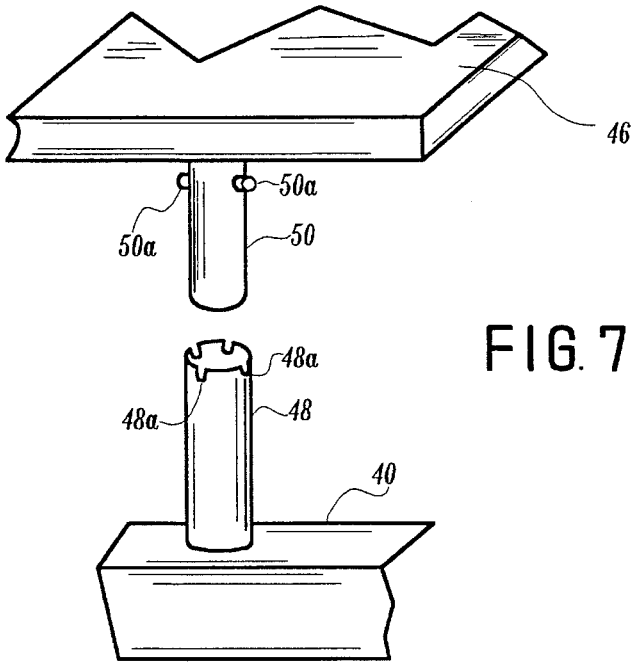
FIG. 7 depicts the detented pivoting bench feature.

Referring to FIG. 1, an exercise bench machine is generally depicted by reference numeral 10 which includes a vertical upper tube 12 of generally square hollow cross section. A pair of elongated, generally rectangular cross section swing arms 14 and 16 are pivotally mounted to a pair of arm brackets 17 and 18 (only 18 of which is visible in FIG. 1), the arm brackets being welded or otherwise suitably attached to the sides of vertical upper tube 12. The swing arms 14 and 16 are part of a triangular support system terminating in a lifting bar support 52. The open ends of the swing arms (or members) are connected by a stop 19 that extends behind the upper vertical tube 12. A vertically oriented lead screw 32 is rotatably supported on upper vertical tube 12 by a top support 22 and a bottom support 24. The lead screw 32 is attached at its top end to a load adjustment lever or crank 34 and has fitted to its bottom end a load adjustment knob 25. A spring means member, in the form of a gas cylinder 30, is coupled by means of a clevis or yoke assembly 38 to lead screw 32 at one end and to an articulated support (illustrated in detail in FIGS. 3 and 4). The articulated support is carried by the swing arms 13 and 14 and establishes a movable apex of the triangular support system. An adjustable stop nut 31 is used for longitudinally moving this apex by adjusting the free length of cylinder 30, as will be described. A base 26 of tubular steel, similar to vertical upper tube 12, is of generally cruciform construction and includes an upstanding lower tube 27 that fits within vertical upper tube 12 for enabling height adjustments of the swing arm assembly. This is accomplished by means of a series of aligned holes (not shown) in lower tube 27 that are engageable by a height adjusting pin assembly 28 that extends through a pair of horizontally aligned holes (not shown) in vertical upper support tube 12. Base 26 has a horizontally extending tube 27A that fits within a base extension 40 that supports a vertically extending bench post 48 and has two side feet 42. The base extension 40 is adjustable along tube section 27A by means of suitable holes (not shown) in tube section 27A and an adjustment pin 41. The adjustable base portion not only accommodates differences in height and size of various users, but also contributes to the ready disassembly of the equipment for packing and shipping, by mail, for example. A bench 46 is supported by a generally T-shaped pedestal 44 on one end and by a cylindrical pivot tube 50 at the other end. Pivot tube 50 fits within bench post 48 and is locked by a pair of detents (FIG. 7). When lifted, pivot post 50 enables bench 46 to be swung out of its normal position beneath a lifting bar 56 into a position at a right angle to the lifting bar. In the latter position, the bench is out of the way of the user who wishes to perform non bench exercises. In this position, the bench may be used as a convenient resting seat, if desired. Finally, a swivel assembly 53 is secured to a lifting bar support 52 which, in turn, supports a universal bearing assembly 54 to which the lifting bar 56 is secured. As will be explained, the arrangement enables universal movement of lifting bar 56 with respect to lifting bar support 53.

Figure 2:
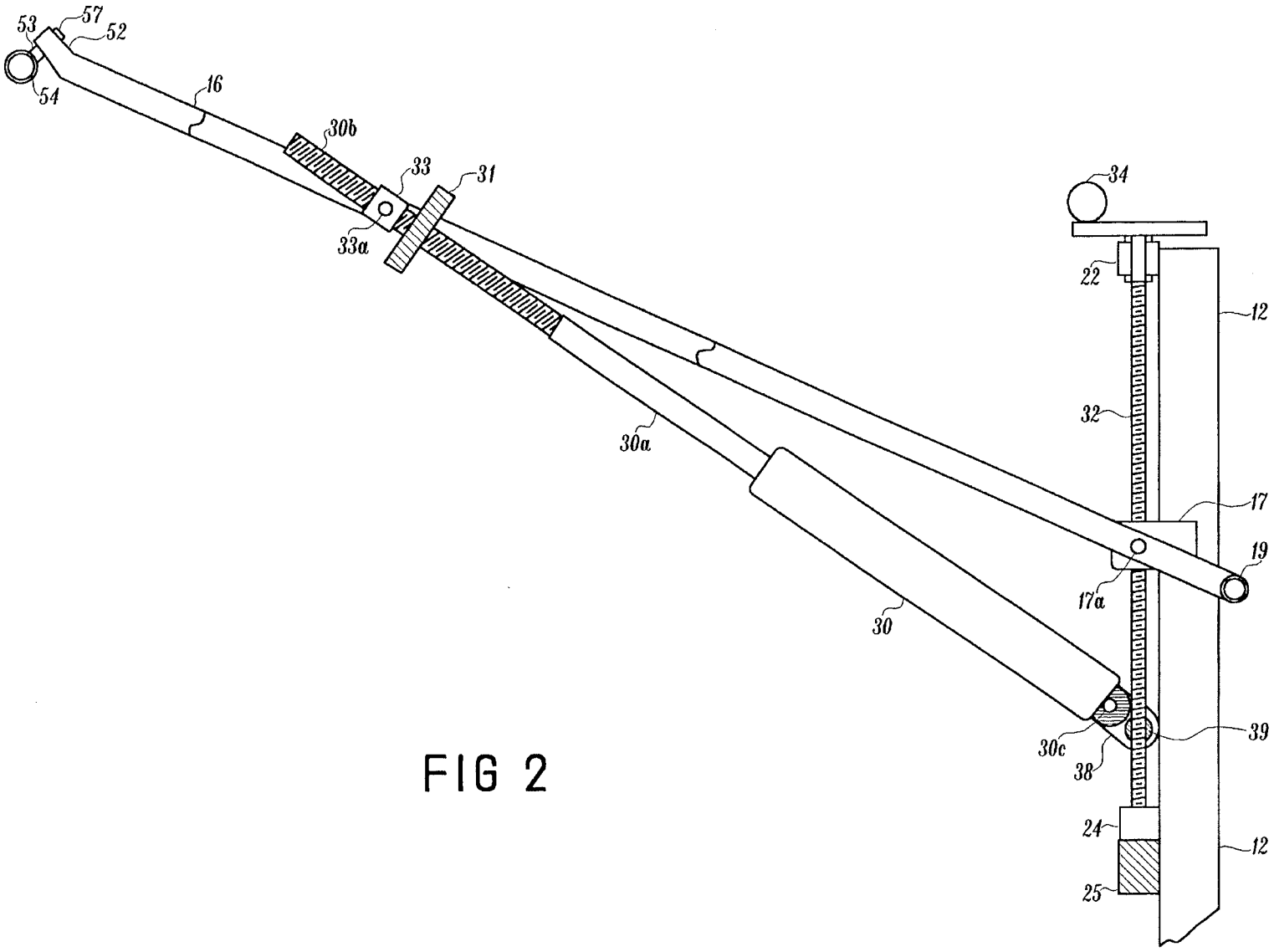
FIG. 2 is a partial view illustrating the swing arms and loading mechanism of the invention.

FIG. 2 and FIG. 3 illustrate the construction and arrangement of the triangular articulated lever system of the invention comprising the swing arm, gas cylinder and lead screw members. Swing arm 16 is partially broken away to illustrate the articulated pivot block 33 that is secured for rotational movement between the swing arms. The pivot block 33 is drilled for passage of a threaded extension 50*b* of a cylinder rod 30*a* which permits adjustment of the free length of cylinder 30. Adjustable stop nut 31 is movable along the threaded extension 30*b* of cylinder rod 30*a* for engaging the inner face of pivot block 33. The other end of cylinder 30 has an extension 30*c* that is threaded, or otherwise secured, in a suitable orifice in clevis assembly 38. As will be seen in more detail in connection with FIGS. 5A–5C, clevis assembly 38 houses a bearing pin that includes a transverse threaded hole which enables it to ride along lead screw 32, with the arms of clevis assembly 38 being rotatable about bearing pin 39. As may be seen from FIG. 2, adjustment of load adjuster crank 34 turns lead screw 32 which drives clevis assembly 38 to change the configuration of the articulated triangular lever system which has apices defined by pins 39, 17*a* and 35. The cylinder 30 in the preferred embodiment is filled with compressed gas (nitrogen) and the threaded extension 30*b* of cylinder rod 30*a* is freely movable within the drilled hole 32*b* (FIG. 4B) in pivot block 33. This is true, of course, only when adjustable stop nut 31 is not engaging pivot block 33. The loading of the exercise device is indicated by the position of a suitable pointer (not shown) carried by clevis assembly 38 with respect to a scale 20 on the front face of vertical upper tube 12 (FIG. 1). When the appropriate load has been selected by the user operating adjuster crank 34 (or knob 25), stop nut 31 is spun up against pivot block 33 to "fix" the configuration of the articulated triangular lever system, i.e. to lock the position of the movable apex. In the FIG. 2 illustration, the exercise device is set up for pull down exercising, that is downward vertical displacement of lifting bar 56, which results in movement of cylinder rod 30*a* into cylinder 30 against the loading provided by the compressed gas in cylinder 30.

Articulated pivot block 33 is shown in detail in FIGS. 4A and 4B and includes an aperture 33*a* in each end for receiving pins 35 (not shown in these views) to support the block for rotational movement between swing arms 14 and 16. Drilled hole 33*b* is large enough to permit ready passage of the threaded extension 30*b* of cylinder rod 30*a* therethrough. Pivot pins 17*a* and 18*a* support swing arms 14 and 16 for pivotal movement on brackets 17 and 18 by means of suitable bushings 41. It will be appreciated that clevis or yoke assembly 38 is at all times free to pass between swing arms 14 and 16 as it is driven along lead screw 32. It will also be noted that the short adjustable load-defining arm member of the triangular articulated lever system comprises the portion of lead screw 32 between a pin 39 and pivot pins 17*a* and 18*a* on the arm brackets 17 and 18. The lead screw 32 is always vertically oriented. This serves to balance the points between the lifting and pull down positions and contributes to the smooth and uniform loading characteristics of the exercise device.

As may readily be visualized by one skilled in the art, adjustment of lead screw 32 to a position where clevis assembly 38 is above pivot pin 17*a* results in the exercise device being set up for lifting exercises since in this orientation, cylinder 30 resists upward movement of the lifting bar 56. In the process, the clevis assembly 38 passes through a zero point at which the triangle of the articulated triangular lever system collapses into a two sided structure. Therefore it is very easy to convert from pull down to lifting exercises. Note that no disassembly of any part of the exercise device is required on the part of the user to accomplish this changeover. Stop 19 joining the open ends of the swing arms 14 and 16 limits the travel of the swing arms by engagement with the rear surface of vertical upper tube 12.

Since in the preferred embodiment for home use cylinder 30 is capable of producing about 1200 pounds of force, adjustable stop nut 31 must be disengaged from pivot block 33 before attempting any movement of lead screw 32 that would lengthen or increase the free length of cylinder 30. Such disengagement, however, is readily accomplished by a user when standing in front of the exercise device. Should a change in loading or release of the lifting bar be desired when the user is lying on the bench, such may readily be made by the user reaching up and spinning adjustable stop nut 31 along the threaded extension 30*b* of cylinder rod 30*a* which enables swing arms 14 and 16 to be readily movable. Movement of adjustment knob 25 will turn lead screw 32.

Adjustable stop nut 31 has a dual purpose. It not only permits ready adjustment of the free length of cylinder 30, as discussed above, but also is used to establish a desired load pickup height for the lifting bar. For example, in a bench press position, the user may wish the lifting bar to take up load at approximately six inches above his chest (to either avoid pressure on his chest, or to facilitate positioning himself for the exercise). After setting the load (by means of load adjuster 34), the height at which the load is picked up can be set by moving adjustable stop nut 31. The lifting bar position may be changed by spinning the adjustable stop nut a turn or two to set a comfortable height. In this configuration, the lifting bar (and swing arm) will be freely movable to the load pickup height, at which point the full force exerted by cylinder 30, through the articulated triangular lever system, will be experienced by the user. As mentioned, the provision of adjustment knob 25 at the lower end of lead screw 32 makes it very simple for a user on the bench to change the load setting of the exercise device. Thus, a user wishing to increase or decrease the load while on the bench need merely turn adjustment knob 25 (after backing off adjustable stop nut 31). It will be appreciated that to increase the load, adjustable stop nut 31 would need to be moved first, as discussed above.

Figure 5C:
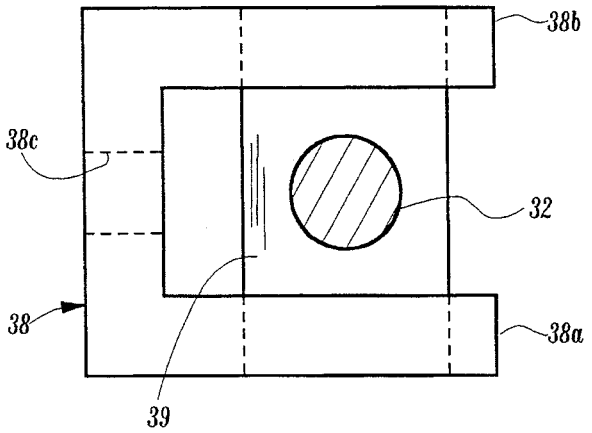
FIGS. 5A, 5B and 5C illustrate the clevis and drive arrangement for the end of the cylinder.
Figure 5A:
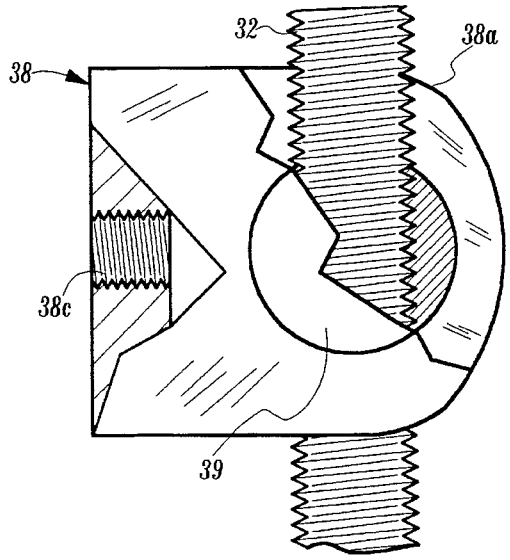
Figure 5B:
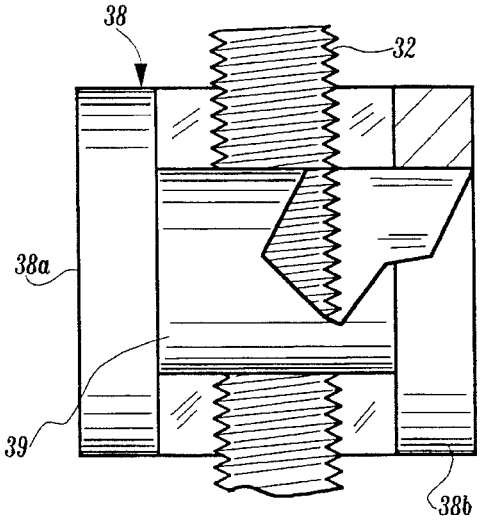

Referring to FIGS. 5A, 5B and 5C, an enlarged, detailed view of the clevis assembly 38 is shown. Clevis assembly 38 is U-shaped and includes legs 38*a* and 38*b* that accommodate a pin 39 for rotational movement in suitable apertures therein. Pin 39 in turn is drilled and threaded to receive the lead screw 32 and clevis assembly 38 will ride along lead screw 32 as the lead screw is rotated. The end portion of the clevis assembly 38 has a tapped hole 38*c* for reception of the end 30*b* of cylinder 30. In practice, a load block (not shown) is positioned between the rear portions of lead screw 32 and pin 39 and the inner face of vertical upper tube 12. The load block is threaded to engage the threads of lead screw 32 and contoured to match the curvature of pin 39 and is thus captivated in position and rides along with clevis assembly 38. The provision of the load block precludes the legs 38*a* and 38*b* being required to support the forces exerted by cylinder 30 against vertical upper tube 12.

Figure 6A:
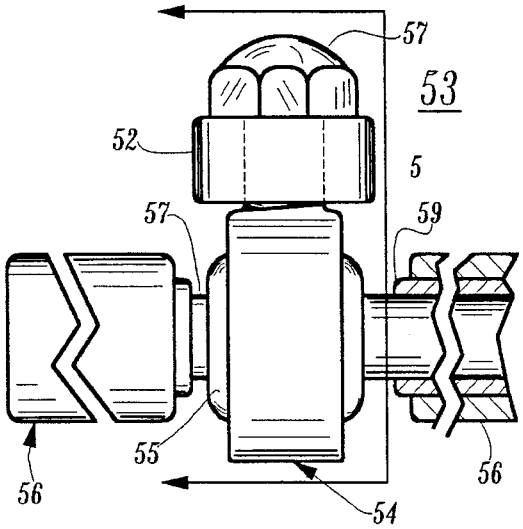
FIGS. 6A and 6B illustrate the universal mount of the lifting bar assembly.
Figure 6B:
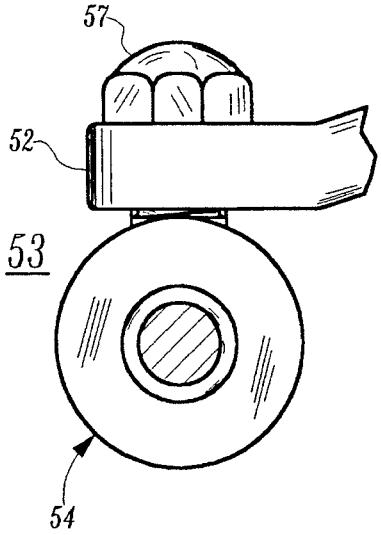

A feature of the exercise device is the universally mounted lifting bar arrangement. As shown in FIGS. 6A and 6B, bar support 52 is journalled to loosely receive the threaded end of a universal bearing assembly 54 of standard construction. Such universal bearing assemblies include a portion of a journalled ball bearing 55 that is rotatable within the housing. A cylindrical steel shaft 57 fits into the central opening in ball bearing 55. The arms of lifting bar 56 are secured by means of bushings 59 that are configured to fit over steel shaft 57 and into the inner diameter of the arms. When assembled, the arms of lifting bar 56 are freely rotatable about its axis and universally movable to the limits imposed by bearing assembly 54. Further, the threaded end of universal bearing assembly 54 is fitted with a locking cap nut 57 which permits a very limited amount of vertical movement of the bearing assembly 54 with respect to bar support 52. The arrangement permits a free swiveling action of bearing assembly 54 with respect to the bar support 52, thus providing a lifting bar arrangement that is rotatable, swivelable and capable of limited universal movement to enable balancing of forces between the left and right arms of the user and for compensating of positioning differences and the like with respect to the bench.

In FIG. 7, the base extension 40 is shown with bench post 48 having two pairs of opposed notches 48*a* formed in the open end thereof. Pivot post 50 (which is attached to the underside of bench 46) telescopes within bench post 48 and includes a pair of pins 50*a* that are engageable with opposite pairs of notches 38*a* to determine two positions for the bench; one under the lifting bar and the other at right angles thereto. It can thus be seen that the bench is readily movable for doing non bench or stand up exercises and remains a part of the exercise machine. As such, it may be used for resting between exercise sets, tying shoelaces and the like.

Figure 8A:
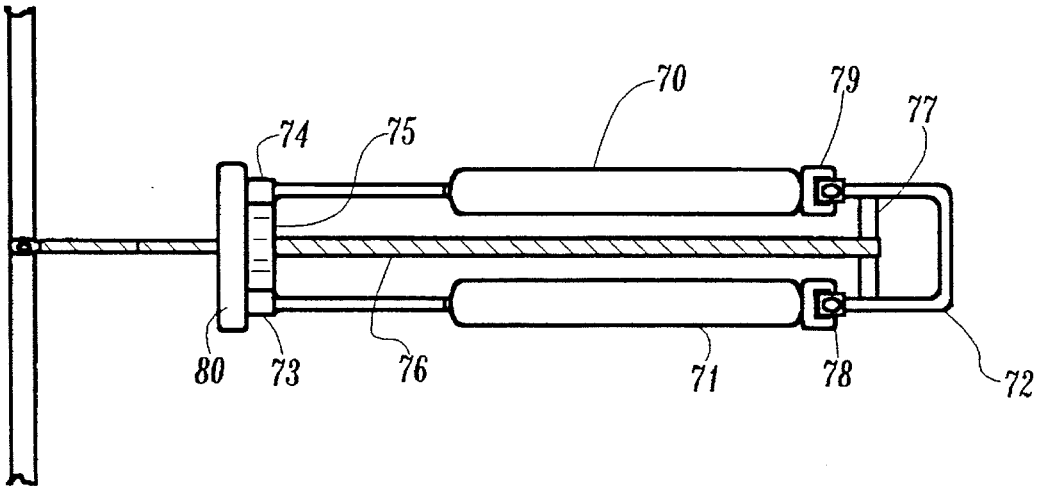
FIGS. 8 and 8A illustrate a two cylinder version of the invention.
Figure 8:
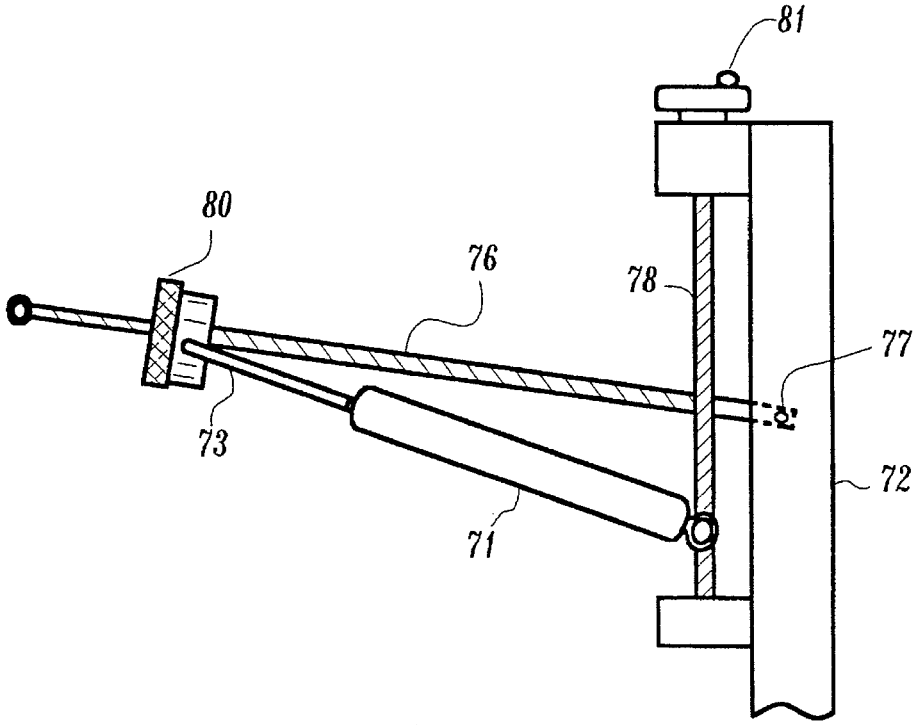

FIGS. 8 and 8A illustrate a version of the invention especially useful for limited stroke (and direction) exercises, such as leg lifts. A pair of cylinders 70 and 71 and a single swing arm 76 are arranged as shown. A cutout portion (not shown) in the front of vertical tube 72 permits the end of swing arm 76 to pivot about a pin 77 in tube 72. Two lead screws 78 and 79 and suitable clevis arrangements drive the ends of cylinders 70 and 71 simultaneously to longitudinally move a pivot block 75 along the threaded end of swing arm 76. A pair of pins 73 and 74 rotatably secure the other ends of cylinders 70 and 71 to a pivot block 75. An adjustable stop nut 80 threadingly engages swing arm 76 to "fix" the position of pivot block 75. A simple drive arrangement of suitable spur gears may be used to simultaneously drive lead screws 78 and 79 by rotation of adjustment crank 81.

A preferred implementation of the exercise device of the invention is shown in FIGS. 9–25. The preferred arrangement is more aesthetically pleasing, the cylindrical tubular frame is exceptionally strong, the pivotal bench is particularly adapted for uneven floors, the novel universal joint for the lifting bar is both smooth operating and cost effective and the load adjustment mechanism is simple and fast acting. Additionally, the preferred implementation incorporates other simplifications and safety features.

Figure 9:
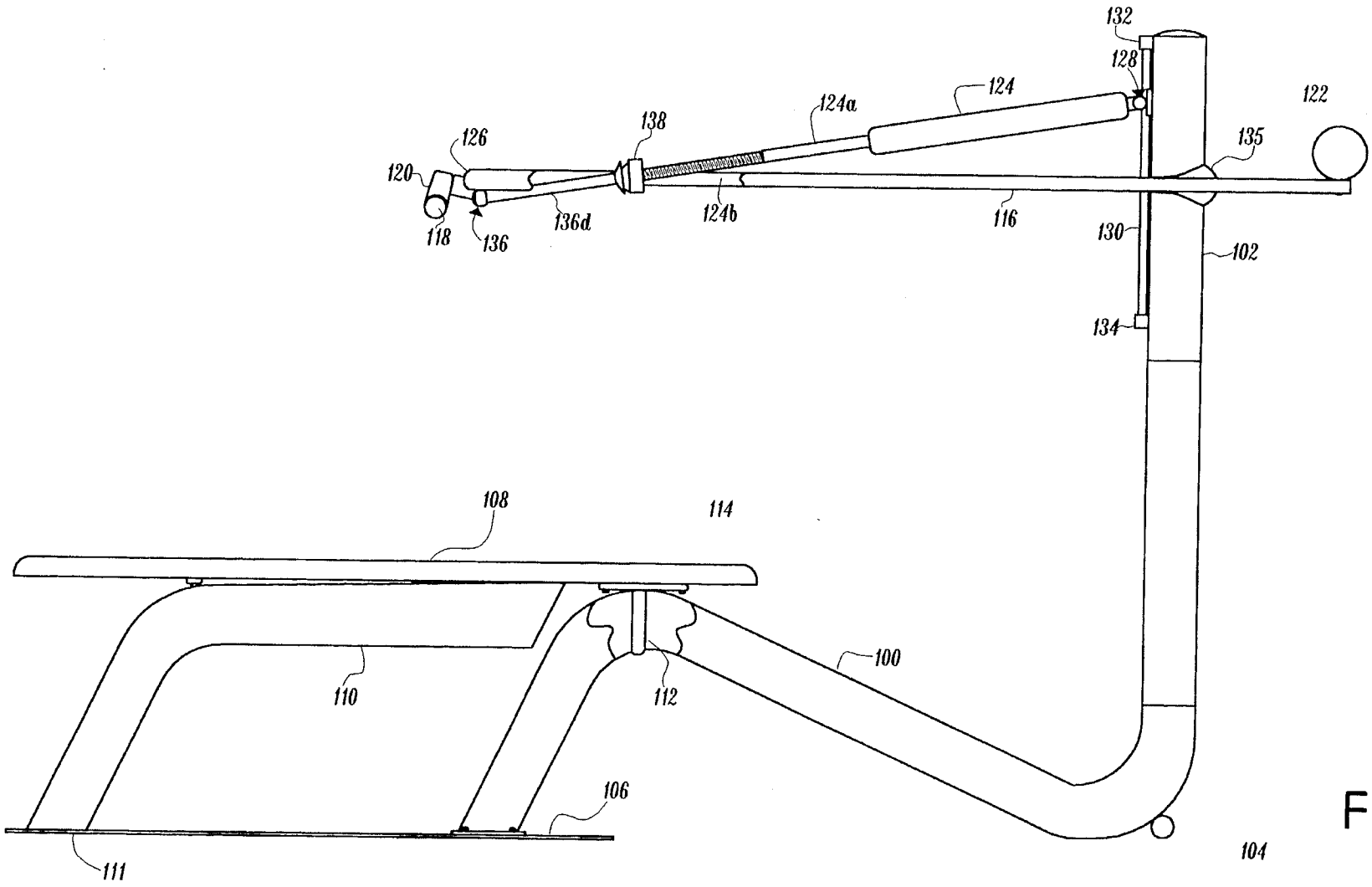
FIG. 9 is a side view of a novel tubular frame arrangement incorporating the exercise device of the invention.
Figure 10:
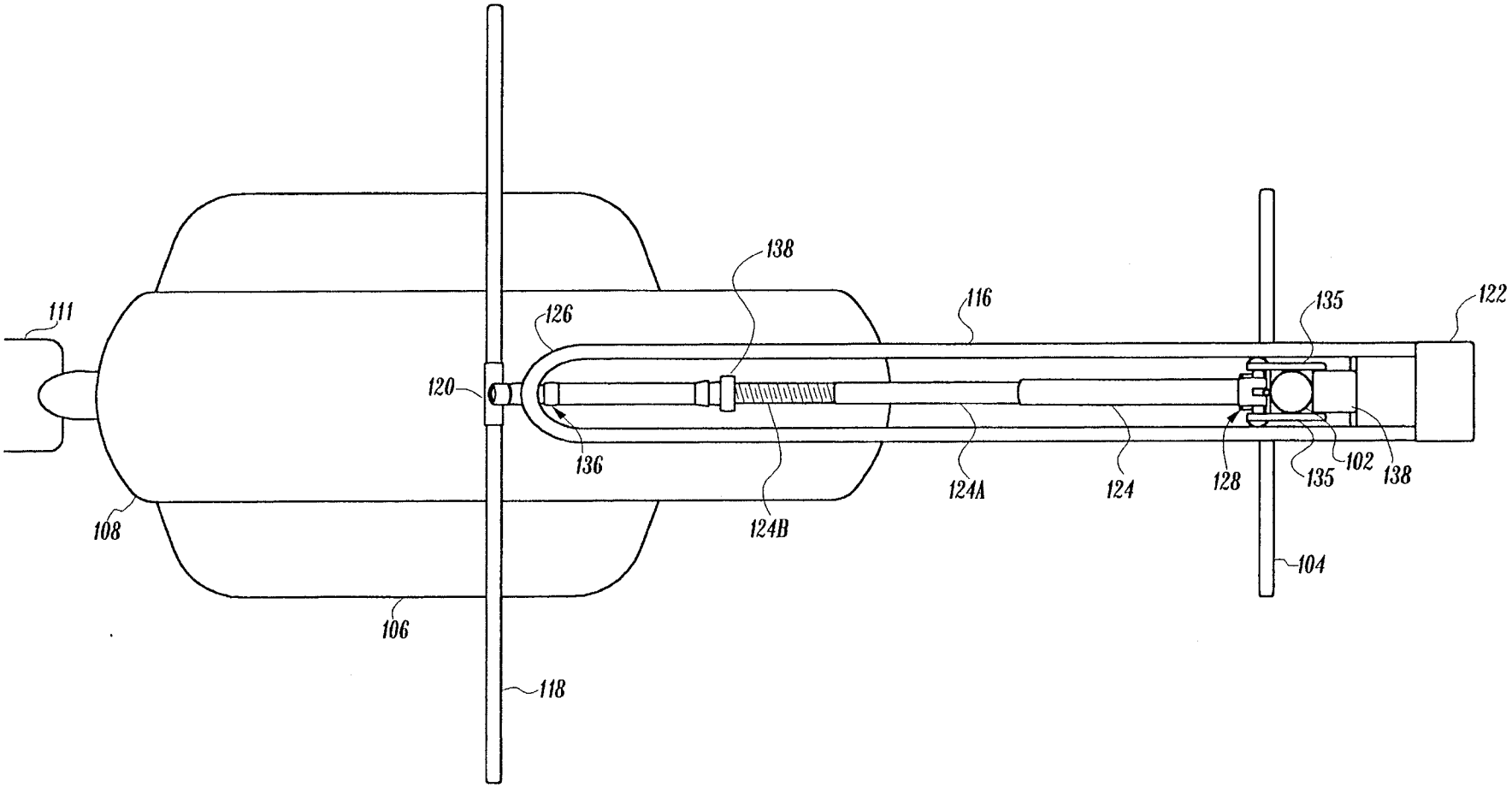
FIG. 10 is a top view of the arrangement of FIG. 9.
Figure 13:
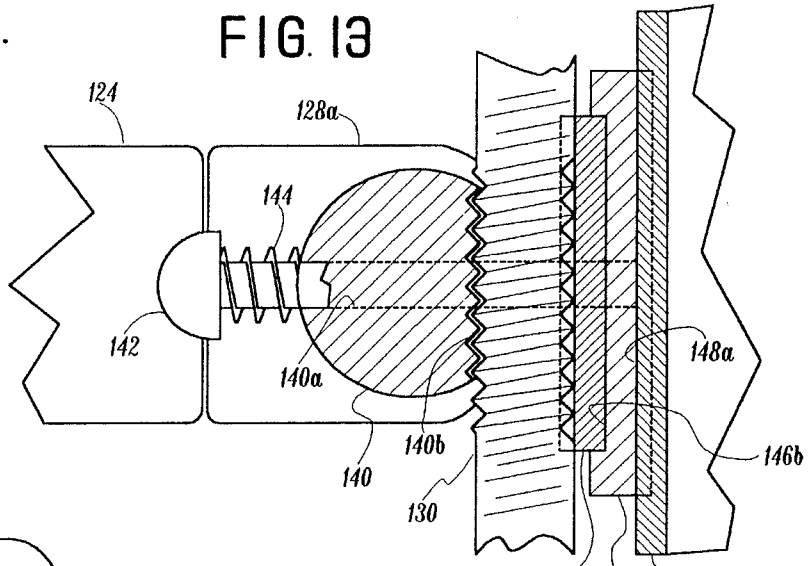
FIG. 13 is an enlarged partial sectional view taken along line 13—13 of FIG. 12.
Figure 12:
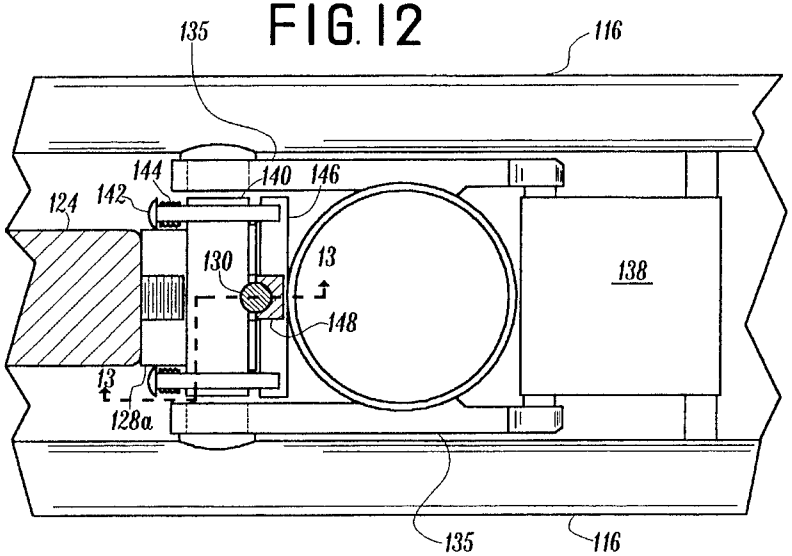
FIG. 12 is an enlarged sectional view taken along line 12—12 of FIG. 11.

FIGS. 9 and 10 represent side elevation and top plan views of a cylindrical tubular exercise bench utilizing the invention. The frame consists of a serpentine shaped base portion 100 and a nesting vertical portion 102. A front support 104 and a large base plate 106 provide stability. A bench 108 is mounted to a rear tubular section 110 that is pivotable with respect to base portion 100. The bench, which may be fabricated of plywood that is suitably padded, is pivotally attached to base portion 100 by a pivot pin 112 (supported by a plate 114 on the underside of bench 108) which fits within a pair of vertically aligned holes (not shown) in base portion 100. The horizontal rear section 110 terminates in a rear foot 111. Bench 108 is attached to rear section 110. The resilience of the plywood bench 108 permits compensation for irregularities in the flooring or support surface on which the exercise bench is positioned.

Upper tube 102 nests and is locked within the vertical section of base portion 100. The separate sections enable the exercise bench to be disassembled for shipping and also enable an extension piece (not shown) to be added for the use of very tall individuals, e.g. those in excess of 6'4" in height. For shorter people, the long swing arm 116 permits standing pull down (or push up) exercises without requiring the swing arm pivot to be raised. As in the previous embodiment, the swing arm 116 is pivotally supported from the upper tube and supports a lifting bar 118 through a universal joint 120. A counter balance 122 is used to offset the weight of the swing arm for easy set up and usage of the exercise bench. A gas cylinder 124 is attached to the bight 126 of the swing arm at one end and to a movable cylinder support 128 at its other end. Movable cylinder support 128 is engageable along the length of a fixed cylinder support 130 that is secured to upper tube 102 by a pair of attachments 132 and 134. A pair of pinch guards 135 are provided to preclude accidental pinching of a person's fingers between the swing arm and the upper tube. The pinch guards also support the swing arm for pivotal movement and are securely affixed to upper tube 102, preferably by welding. A belt 138 limits the angular movement of the swing arm 116. The cylinder 124 has a cylinder rod 124A and a threaded end 124B that rides in a stop tube 136*d* which terminates in a ball joint 136. A stop nut 138 is movable along threaded end 124B into engagement with the stop tube. As will be seen, the ball joint and stop tube (and the stop nut) are improved over the articulated mount of the prior described exercise bench.

In FIG. 11, fixed cylinder support 130 is seen to be a threaded screw. Unlike the previous embodiment, threaded screw 130 is stationary, being rigidly supported at its extremities by attachments 132 and 134. It will be appreciated that the fixed cylinder support may take any form of positioning device, such as a gear rod, detent positions and the like. The threaded screw is a convenient and presently preferred form. Movable cylinder support 128 is readily movable along threaded screw 130 by virtue of a positioning pin 140 that is spring loaded into engagement with threaded screw 130. A slidable load block backing plate 146 engages upper tube 102 and supports threaded screw 130 against the force exerted by cylinder 124. Spring loading of positioning pin 140 is provided by a pair of pins 142 and springs 144. As mentioned, the pinch guards 135 are welded to opposite surfaces of upper tube 102 and pivotally support swing arm 116 by a pair of pivot pins 135*a*. Belt 138 is seen to extend around a pin 135*b* joining pinch guards 135 and a pin 116*a* coupled between the two side tubes of the swing arm 116.

Figure 15D:
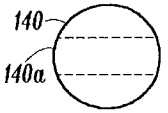
FIGS. 15A–15D are various views of the locking pin carried by the yoke.
Figures 15A, 15B, 15C:
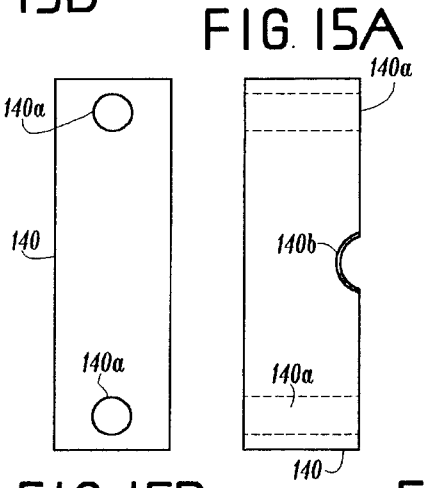
Figures 14A, 14B, 14C, 14D:
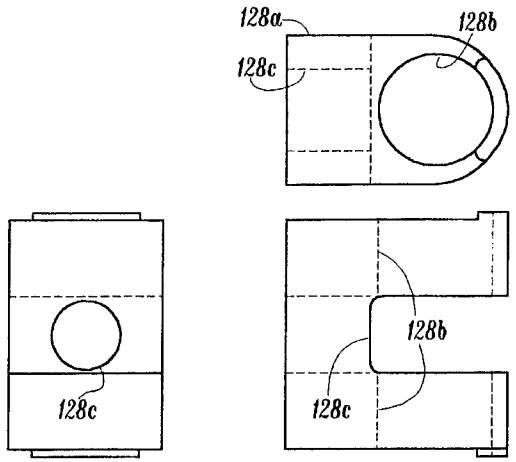
FIGS. 14A–14D are various views of the molded yoke of the locking mechanism.
Figure 19:
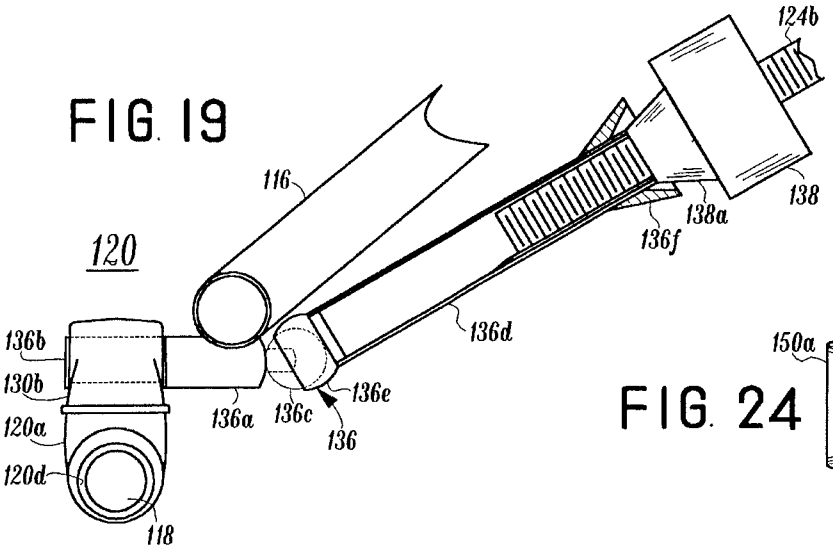
FIG. 19 is a side view of FIG. 18.
Figure 18:
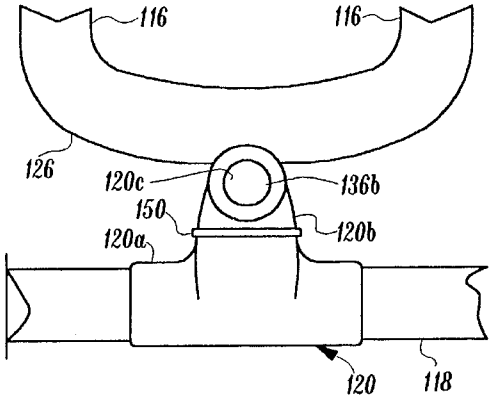
FIG. 18 is an enlarged partial top view of the novel universal hinge for the lifting bar.
Figure 24:
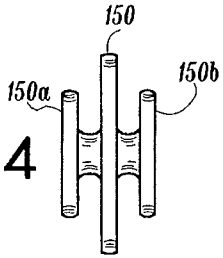
FIG. 24 is an end view of the steel spool used in the universal hinge.
Figure 25:
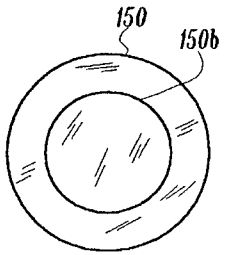
FIG. 25 is a side view of FIG. 24.
Figure 23:
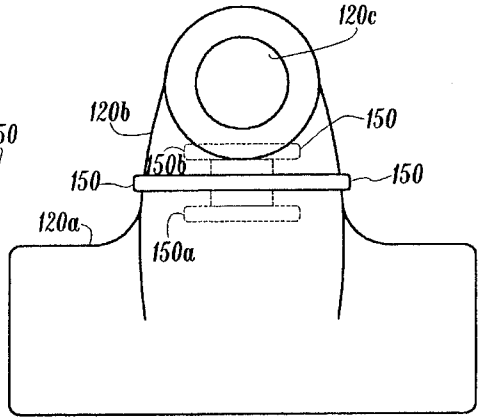
FIG. 23 is a side view of FIG. 22.
Figure 22:
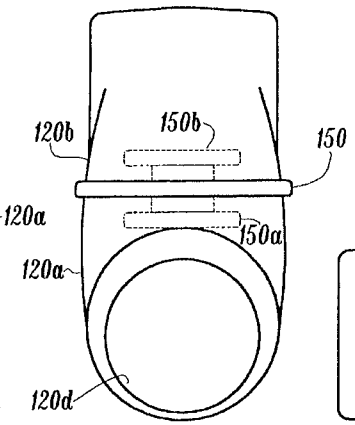
FIG. 22 is a view of the universal hinge with the upper and lower portions rotated 90°.
Figure 21:
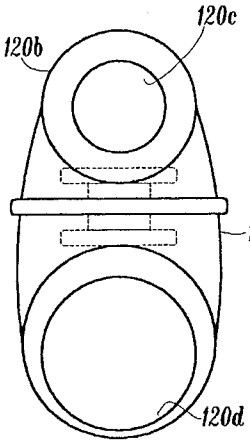
FIG. 21 is a side view of FIG. 20.
Figure 20:
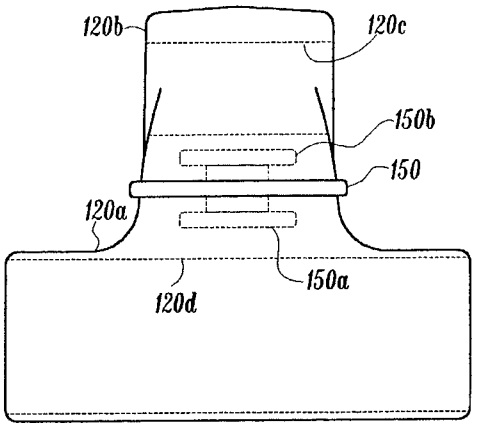
FIG. 20 is a view of the universal hinge as it is molded.

Referring to FIGS. 12–17, the operation of the movable cylinder support 128 will be discussed. Movable cylinder support 128 includes a yoke or clevis 128*a* having an aperture 128*c* in its body for receiving the end of cylinder 124 (FIG. 14). Holes 128*b* are formed in the legs of yoke 128*a* for receipt of positioning pin 140 (FIG. 15). Positioning pin 140 includes a pair of holes 140*a* for passage of pins 142 and a groove 140*b* in which is formed a partial mating thread for threaded screw 130. Slidable backing plate 146 (FIG. 16) is preferably molded and includes a pair of holes 146*a* in which the ends of pins 142 are secured (by any suitable means) and a rectangular recess 146*b* in which a semi cylindrical steel insert 148 is secured. The inner diameter of steel insert 148 matches the outer diameter of threaded screw 130 which permits the steel insert 148 to be easily slidable along threaded screw 130. The opposite surface of backing plate 146 has a curved depression that matches the outer diameter of upper post 102.

To readjust the position of cylinder 124 along threaded screw 130, the user simply grasps the cylinder 124 and pulls it away from the threaded screw 130 against the slight resistance exerted by springs 144. This clears the threaded groove 140*b* in the face of positioning pin 140 from the threaded screw 130 and enables the cylinder support to be easily moved along the length of threaded screw 130. (It will, of course, be recalled that the cylinder must first be unloaded by moving stop nut 138 out of engagement with the stop tube. An indicator plate (not shown) enables very accurate load settings by positioning of the cylinder support. This very simple mechanism replaces the crank load adjuster 34 in FIG. 1 and permits easy, rapid and accurate adjustments of the loading of the lifting bar.

Another aspect of the invention is seen in FIGS. 18–25. The bight 126 of swing arm 116 is welded to a bar hitch or post 136*a* (FIG. 19) that has a ball 136*c* secured to one end and a pin 136*b* affixed to the other end. A hollow tubular stop tube 136*d* is sized such to permit threaded extension 124*b* (of cylinder 124) to slide without it. Threaded end 136*b* terminates in a cup 136*e* in which ball 136*c* is captivated. The universal joint 120, which supports lifting arm 118, is rotatably mounted on pin 136*b*.

A collar 136*f* is secured to the open end of stop tube 136*d*. A generally matching tapered end 138*a* of jam nut 138 abuts against the end of stop tube 136*d* for fixing the free length of the cylinder arm. The tapered end 138*a* and funnel shaped collar 136*f* of the stop tube preclude the possibility of a user having his fingers "pinched" between the stop nut and the stop tube. Because threaded end 124*b* is an acme thread, there is a slight possibility of this occurring. The arrangement obviates the problem and is a safety feature.

As best seen in FIGS. 20–25, rotatable joint 120 comprises three pieces. One piece, a lower portion 120*a* defines an aperture in which lifting bar 118 is rotatable. Another piece, an upper portion 120*b* defines an aperture 120*c* which rotatably engages pin 136*b*. The two portions 120*a* and 120*b* are rotatable with respect to each other by virtue of a captivated third piece, namely a steel spool 150 that has a large diameter center flange and two smaller diameter flanges 150*a* and 150*b*. The flanges are circular and flanges 150*a* and 150*b* are captivated in portions 120*a* and 120*b*, respectively, and provide bearing surfaces therefor.

Preferably, rotatable joint 120 is formed by injection molding a nylon type material with steel spool 150 in place. The spool 150 divides a mold cavity into two halves and the two portions are separately gated. The steel spool may be treated with a release agent prior to molding to enhance its ultimate bearing function. The injected plastic does not adhere to the steel spool and upon release from the mold, the two portions 120*a* and 120*b* may be readily rotated relative to each other with the plastic and the adjoining surfaces of the metal spool forming bearings. The cored holes 120*d* and 120*c* in universal joint 120 provide good bearing surfaces for the lifting bar 118 and bar hitch pin 136*b*, respectively.

What has been described is a novel exercise device that provides a very constant load that is free from the inertial effects of free weights. Because of the triangular articulated lever system utilized, even very small motion exercises such as shrugs, wrist curls and the like can be performed. Further, the loading of the exercise device is readily adjustable from about two pounds to the full force provided by the cylinder used. In the preferred embodiment for home use, a maximum load of 250 pounds has been established. For institutional use, the maximum load may be higher. The increased loading may conveniently be provided by either a single cylinder of greater load capacity or preferably by adding a second cylinder in parallel with the first cylinder and suitably modifying the clevis arrangement and sing arm assembly to accommodate the larger cylinder array. The invention utilizes a long swing arm assembly which maintains a substantially horizontal attitude for the swing arms throughout the exercises.

It is recognized that numerous changes in the described embodiment of the invention will be apparent to those skilled in the art without departing from its true spirit and scope. The invention is to be limited only as defined in the claims.

What is claimed is:

1. A method of providing a variable load and a variable starting position for an exercise device comprising:

providing an articulated triangular lever arm system with a spring means having a free length as one arm thereof; and independently adjusting the lengths of two arms of said articulated triangular lever arm system.

2. The method of claim 1 wherein said spring means comprises a sealed gas cylinder having a preload of about 1200 pounds.

3. An exercise device for providing an adjustable load and a variable free starting position comprising:

an articulated triangular lever arm system having three arms;

a spring means having a free length being one arm of said triangular lever arm system; and means for independently adjusting the lengths of two of said three arms of said articulated triangular lever arm system.

4. An exercise device for providing an adjustable load comprising:

a triangular articulated lever system including;

a load-defining independently adjustable variable length arm;

a swing arm pivotally mounted to a first end of said load-defining variable length arm;

a spring arm pivotally mounted to a second end of said load-defining variable length arm;

the length of one of said swing arm and said spring arm also being independently adjustable; and a coupling forming an apex of said spring arm and said swing arm, said apex being longitudinally movable along one of said spring arm and said swing arm.

5. The exercise device of claim 4 wherein said coupling is mechanically engaged in one longitudinal direction only.

6. The exercise device of claim 4 wherein said spring arm comprises a sealed compressed gas cylinder.

7. The exercise device of claim 4 wherein said spring arm has a free length that is mechanically adjustable and includes a threaded rod; and an adjustable stop nut on said threaded rod for adjusting said free length of said spring arm.

8. The exercise device of claim 4 wherein said coupling includes:

a stop tube pivotally mounted on one of said swing arm and said spring arm; and further including:

an adjustable stop nut engageable with said stop tube.

9. The exercise device of claim 4 wherein the direction of operation thereof is reversible by adjusting the relative angle of said spring arm and said swing arm in said triangular articulated lever system through a zero degree position.

10. The exercise device of claim 4 wherein said variable length arm comprises a positioning device and further including releasable engagement means pivotally mounting said spring arm to said second end of said variable length arm, said releasable engagement means normally being in mating engagement with said positioning device.

11. The exercise device of claim 10 wherein said releasable engagement means includes a molded yoke coupled to said spring arm and said position device includes a threaded screw;

a positioning pin rotatably secured in said yoke, said positioning pin having a partially threaded portion for engagement with said threaded screw; and means for spring loading said positioning pin into engagement with said threaded screw.

12. The exercise device of claim 11 wherein said releasable engagement means further includes a backing plate slidable along said threaded screw; and means captivating said yoke to said backing plate.

13. The exercise device of claim 4 further including:

a lifting bar; and a universal hub having more than one degree of freedom coupling said lifting bar to said swing arm.

14. An exercise machine comprising:

a serpentine shaped tube defining a straight vertical portion, a first curved foot portion and a second, oppositely curved, seat portion;

a loading mechanism supported on said straight vertical portion;

a bench pivotally coupled at one end to said seat portion for horizontal movement; and base support means for maintaining said tube in a vertical orientation.

15. The machine of claim 14 wherein said bench comprises a generally rectangular support;

a tubular frame underlying said support, said tubular frame including a foot plate; and said support yielding to compensate for slight variations in level of said base support means and said foot plate.

16. The machine of claim 14 wherein said loading mechanism comprises a spring loaded swing arm, and further including:

a lifting bar;

a universal hub joining said lifting bar to said swing arm; and said universal hub having two rotatably joined sections, one section rotatably supporting said lifting bar and the other section rotatably mounted to said swing arm.

17. A method of providing an adjustable load and an adjustable starting position for an exercise device comprising:

providing an articulated triangular lever system with a spring means having an adjustable free length as a first member thereof and a swing arm, through which said first member may pass, as a second member thereof;

coupling one end of said spring means to an articulated mount near an apex defined by said first and second members;

coupling the other end of said spring means and the other end of said swing arm to a third member of said triangular lever system opposite said apex; and adjusting said third member.

18. The method of claim 17 wherein said spring means comprises a sealed gas cylinder having a threaded rod coupled to said articulated mount by means of an adjustable stop nut.

19. A method of providing adjustable load forces and an adjustable starting position for an exercise device comprising:

providing an articulated triangular lever system with a spring arm and a swing arm as members thereof;

pivotally connecting one end of each of said spring arm and said swing arm to a variable length load-defining arm;

the lengths of two of said spring arm, said swing arm and said load-defining arm being independently adjustable;

establishing an apex of said articulated triangular lever system that is longitudinally movable along one of said swing arm and said spring arm; and adjustably securing the position of said apex against said load forces.

20. The method of claim 19 wherein said spring arm comprises a pair of sealed gas cylinders straddling said swing arm.

21. The method of claim 18 wherein said swing arm includes a threaded end coupled to said mount and wherein said mount is secured by an adjustable stop nut movable along said threaded end.

22. An exercise bench comprising:

a loading mechanism;

a lifting bar; and a universal hub coupling said lifting bar to said loading mechanism, said universal hub having more than one degree of freedom and enabling both pushing and pulling forces to be exerted on said loading mechanism by said lifting bar.

23. The exercise bench of claim 22 wherein said universal hub comprises two rotatably coupled sections, one section rotatably supporting said lifting bar and the other section rotatably mounted to said loading mechanism.

24. The exercise bench of claim 23 wherein said loading mechanism comprises a spring loaded swing arm.

25. The exercise bench of claim 23 wherein said rotatably coupled sections comprise portions molded about a steel spool, both said sections defining rotational bearing surfaces.

* * * * *